US005727825A

United States Patent [19]

Spurr

[11] Patent Number: 5,727,825

[45] Date of Patent: Mar. 17, 1998

[54] LATCH ASSEMBLY

[75] Inventor: Nigel Victor Spurr, Birmingham, United Kingdom

[73] Assignee: Rockwell Light Vehicle Systems (UK) Ltd., Birmingham, United Kingdom

[21] Appl. No.: 628,661

[22] PCT Filed: Oct. 10, 1994

[86] PCT No.: PCT/GB94/02208

§ 371 Date: Apr. 12, 1996

§ 102(e) Date: Apr. 12, 1996

[87] PCT Pub. No.: WO95/10679

PCT Pub. Date: Apr. 20, 1995

[30] Foreign Application Priority Data

Oct. 13, 1993 [GB] United Kingdom ..... 9321156

[51] Int. Cl.[6] ..... E05B 15/02

[52] U.S. Cl. ..... 292/341.12; 292/DIG. 56

[58] Field of Search ..... 292/341.12, 340, 292/DIG. 53, DIG. 56, DIG. 73

[56] References Cited

U.S. PATENT DOCUMENTS 3,848,911 11/1974 Watermann et al. ..... 292/341.12 X
4,165,112 8/1979 Kleefeldt ..... 292/341.12 X
4,869,536 9/1989 Kleefeldt ..... 292/341.12
4,941,696 7/1990 Yamada et al. ..... 292/340
5,064,229 11/1991 Hamada et al. ..... 292/341.12 X
5,141,270 8/1992 Shibata ..... 292/DIG. 56 X
5,209,532 5/1993 Nakamura et al. ..... 292/340 X
5,316,354 5/1994 Arabia, Jr. et al. ..... 292/340

*Primary Examiner*—Rodney M. Lindsey
*Attorney, Agent, or Firm*—Learman & McCulloch

[57] ABSTRACT

Latch assembly for securing vehicle doors and other closures such as boot lids or tail gates co-acts with a conventional striker releasably retained by a pivoted claw or other catch mechanism to hold the striker in a mouth of the assembly. A displaceable jaw or, preferably, pair of opposing jaws conveniently form part of a unitary sub-assembly including a yoke connecting inner ends of the jaws which is displaceable inwardly of the mouth. The jaws have wedging surfaces that co-act with corresponding wedging surfaces of a latch body to provide laterally inward wedging action as the jaws are carried inwardly by the striker for positive non-rattle location of the latter. A resilient buffer may be provided which is compressed by the striker at the closed position.

21 Claims, 1 Drawing Sheet

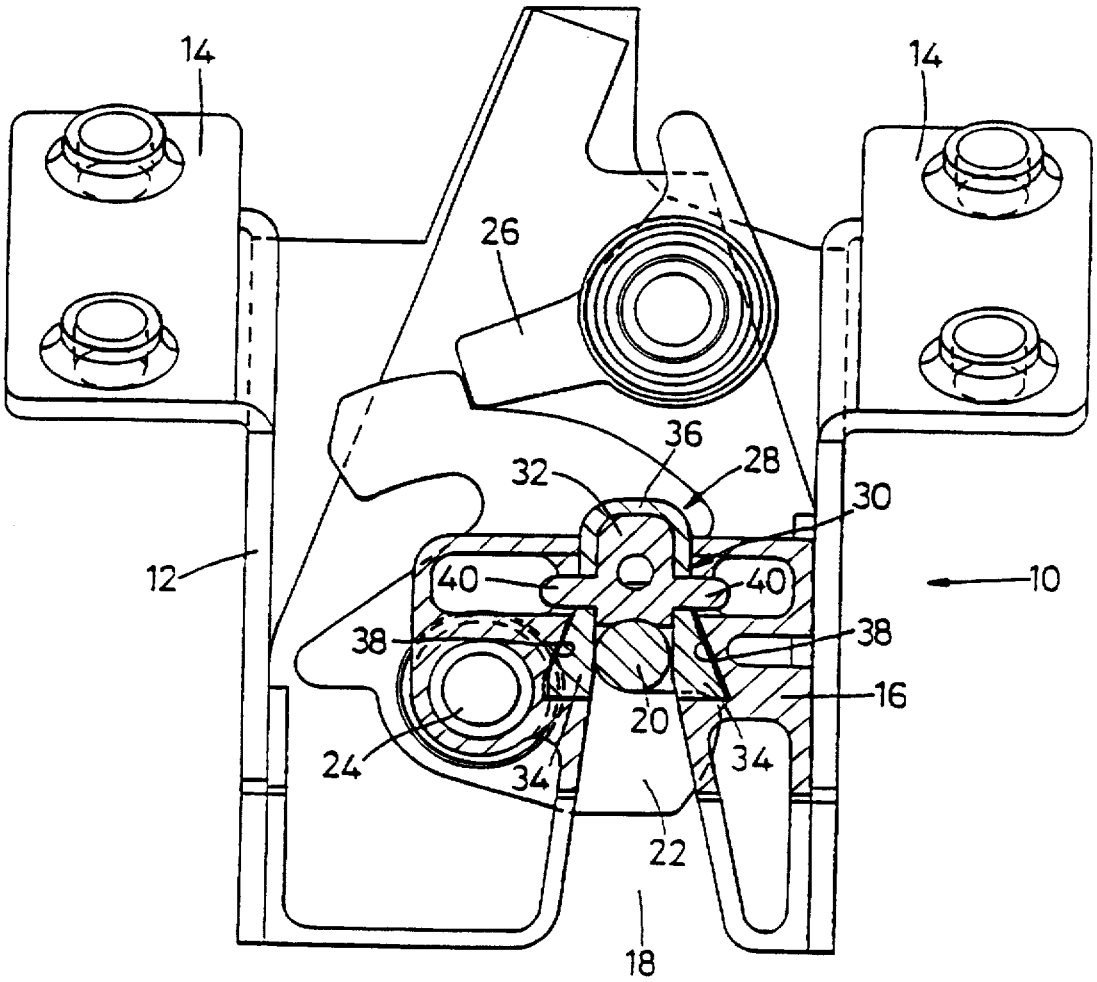
14
14
26
36
28
32
30
12
40
40
10
38
38
16
20
24
34
34
22
18

LATCH ASSEMBLY

This invention relates to latch assemblies for securing doors and other closures, particularly but not exclusively on passenger and other vehicles. In the case of vehicles the latch assemblies may be used for passenger doors, or for such closures as boot or trunk lids, tailgates, bonnets and the like.

BACKGROUND OF THE INVENTION

The latch assembly is usually mounted on the door or other closure to coact with and engage a striker element on the door post or other frame. However, for some applications the latch assembly may be mounted on the fixed post or other frame to coact with a striker carried on the door or other closure, one common example being a vehicle bonnet latch.

In all cases, particularly in connection with vehicles, it is important chat the mechanism of the latch engages the striker positively whenever the door or other closure is closed and that it cannot be accidentally displaced or released from its secured condition. Hence, the striker needs to be brought into accurate alignment with the operative parts of the latch assembly despite the effects of unavoidable, manufacturing tolerances, vibration and flexure of the closure and its frame, and wear and tear.

Furthermore any play between the striker and the latch assembly in the closed condition may result in unacceptable rattles and squeaks and will also cause additional wear on locating surfaces and other parts of the mechanism which will rapidly worsen the condition.

There have been various proposals for accommodating wear and misalignment in latch assemblies and coacting strikers, for example forming interengaging parts thereof of wear resistant plastics materials having a limited degree of resilience, and/or incorporating resiliently loaded displaceable pads or buffers but these intended solutions have not always proved successful in practice as regards effectiveness, resistance to wear in long term use, and ease of manufacture and assembly.

The object of the present invention is co provide a latch assembly of simple and economical construction which is particularly effective, safe and secure in use, has good durability and resistance to wear, and which provides particularly effective and accurate positioning and retention of the striker at the closed condition in a simple manner.

SUMMARY OF THE INVENTION

According to the invention there is provided a latch assembly for operative mounting on a door or other closure or on a frame thereof for releasable engagement with a striker element of the other of the frame or closure to secure the closure in its closed condition, said assembly including a latch body having a mouth in which the striker element is received, and releasable catch mechanism automatically retaining said element at an inward closed position thereof in the month; characterised in that said assembly further includes a pair of spaced jaws constituting opposing side walls of the mouth, at least one said jaw being displaceable and resiliently urged to an outward position in the mouth at which the striker can enter between it and the other said jaw, inward relative movement of the striker to the closed position carrying said at least one jaw inward to be acted on by a wedging formation of the body which urea that jaw towards said other jaw for laterally gripping engagement of the striker.

Preferably both jaws are displaceable, resiliently urged to an outward position, and carried inward to be acted on by opposing wedging formations of the body on said inward movement of the striker for said gripping engagement therewith.

Conveniently the pair of displaceable jaws are linked by a yoke at the innermost end of the mouth, said inward movement of the striker being applied through said yoke to carry both jaws inward in unison.

The displaceable jaws and yoke may be formed as a unitary component, typically a U-section resilient plastics moulding or extrusion.

Preferably the assembly further includes a resilient buffer within the mouth which is abutted by the striker at the closed position, the engagement of the latter with the buffer serving no carry the jaw or jaws inwards as aforesaid.

Said buffer is preferably a body of elastomeric material but a springloaded buffer formation could be used.

The or each displaceable jaw is conveniently wedge shaped with faces conversing inwardly of the mouth, the laterally outer face of the respective jaw coacting an opposing outwardly diverging face of the body, other shapes or arrangements of jaw and opposing wedging formations may be employed.

THE DRAWINGS

An example of the invention is now, more particularly described with reference to the accompanying drawing being a sectional view of a vehicle boot, trunk or tailgate latch assembly in a closed condition with coacting striker secured thereby.

DETAILED DESCRIPTION

Latch assembly 10 has a composite latch body comprising a pressed metal outer shell 12 which includes mounting lugs 14 for securing the assembly to a closure such as a boot lid (not shown) in conventional manner. The body further includes a moulded plastics body core 16 which locates and encloses catch mechanism of the assembly.

The body defines a mouth 18 opening to its lower face as viewed in the drawing and having inwardly convergent side walls.

The assembly coacts with a striker 20 formed of cylindrical metal bar shown only in cross section in the drawing which is mounted in conventional manner at a fixed location on the frame of the lid or tailgate opening.

In the fully closed condition shown in the drawing striker 20 has entered mouth 18, the outer tapered walls of the latter guiding and centering it if there should be any initial misalignment. As it approaches-the closed position it will have engaged and rotated a pivoted claw 22 of the mechanism anti-clockwise as viewed in the drawing about its claw shaft 24 until a resiliently loaded latching pawl 26 pivoted within core 16 releasably engages a radial face of the claw in known manner, securing striker 20 captive in mouth 18.

The side walls of mouth 18 at the inner region occupied by striker 20 are undercut to form a widened chamber. A jaw sub-assembly 28 fits into this chamber and consists of a jaw unit 30 and a buffer 32 within said unit.

In more detail unit 30 is a unitary moulding or extrusion of durable wear resistant plastics of generally U-shaped cross section, the limbs of the U being a pair of spaced opposing jaws 34 linked by a yoke 36.

As assembled yoke 36 defines the innermost end of mouth 18 and is spaced inwardly from the closed position of striker 20. Jaws 34 lie to each side of striker 20 and each jaw 34 is wedge shaped, their laterally inner faces being substantially parallel in an undeflected condition while their laterally outer faces are angled to converge inwardly of mouth 18 in the direction of yoke 36. The laterally outer walls defining said chamber in core 16 also converge inwardly at the same angle and sub-assembly 28 fits snugly therein.

Buffer 32 is formed from durable elastomeric material and is shaped to fill the space between the inner parts of jaws 34 and between yoke 36 and striker 20 so that it is somewhat compressed by the latter.

A pair of ears 40 integral with the main part of buffer 32 extend through short slots in jaws 34 and into clearance openings in core 16 to prevent displacement of buffer 32 from mouth 18.

In use as striker 20 becomes fully engaged in mouth 18 to be secured by the catch mechanism of the assembly 10, it compresses buffer 32 so carrying the whole jaw sub-assembly 28 inwardly engaging it more deeply in mouth 18.

As this displacement takes place the pair of jaws 34 are forced towards each other by the wedging action of the converging walls 38 so that they are urged into laterally gripping engagement with striker 20.

As the wedging action is applied equally from both sides striker 20 is positively located and centered in accurate alignment with the acting parts of latch assembly 10 and without being subjected to any unbalanced forces. At the same time it is located longitudinally of mouth 18 by buffer 32 supplementing the locating effect of claw 22 and cushioning it against rattling or vibration.

Jaw sub-assembly 28 itself has a degree of resilience which will accommodate any slight misalignments and also take up any wear which may occur.

The components of jaw unit 30 are economical to produce and simple to assemble, no fastenings being required for their location. They are expected to be long-lasting and subjected to little wear in service though they can readily be replaced if need arises.

It is to be understood that the invention may be applied to latch assemblies having other forms of catch and/or locking mechanism than that described above; and/or to latch assemblies coacting with other types or forms of striker than that referred to above, e.g. strikers of wedge shape or other non-circular section.

The jaw sub-assembly may also take different forms, for example the pair of jaws and the yoke might be separate components operatively linked together and/or the jaws themselves need not be wedge shaped, jaws having parallel inner and outer faces could be wedged towards each other to grip a striker by various forms of camming or other formations of the latch body as they are displaced inwardly of the mouth.

In some constructions the resilient buffer within the jaws might be dispensed with, e.g. the striker 20 could engage yoke 36 or its equivalent directly with resiliently outward loading, e.g. by a compression spring, applied outside the yoke, or possibly the inherent resilience of the jaw sub-assembly itself might be arranged to provide sufficient springloading for some purposes.

In other applications the jaw at one side of the mouth 18 may be fixed, e.g. it may be an integral part of body core 16 or of a fixed insert therein, and only the jaw at the other side of the mouth will be resiliently displaceable and wedged laterally towards the fixed jaw to grip striker 20 as it reaches the closed position. Thus jaw unit 30 may comprise a single jaw 34 coacting with a conveying wall 38 and a hook shaped yoke, and locating a buffer similar to buffer 32. This single jaw unit may be advantageous where there are limitations of space though it will not provide the self-centering action of the double jaw form.

I claim:

1. A latch assembly comprising:

a latch body mountable on one of two structures that are movable relative to one another between open and closed positions, said body having a longitudinal mouth open to receive therein a striker element mounted on the other of the two structures;

a releasable catch mechanism mounted on said body operative to engage and retain the striker element upon movement of the latter to an inward position within said mouth; and a pair of jaws supported in laterally spaced relation along opposite sides of said mouth to accommodate the striker element therebetween, at least one of said jaws being longitudinally displaceable along said mouth from a longitudinally outward position to a longitudinally inward position in response to moving the striker element to its inward position within said mouth, and said at least one jaw being further resiliently displaceable laterally toward the other of said jaws in response to said movement of said at least one said jaw from said longitudinally outward position to said longitudinally inward position to engage and releasably grip the striker element between said jaws.

2. The assembly of claim 1 wherein said at least one jaw is resiliently biased constantly toward said longitudinally outward position.

3. The assembly of claim 1 wherein said body and said at least one jaw have complemental surfaces that co-act to cause said lateral displacement of said jaw.

4. The assembly of claim 1 wherein both of said jaws are longitudinally and laterally displaceable.

5. The assembly of claim wherein said body and said jaws have complemental surfaces that co-act to cause said lateral displacement of said jaws upon said longitudinal displacement of said jaws.

6. The assembly of claim 5 including a yoke portion coupling said jaws at a longitudinally inward end thereof for interacting with the striker element to effect said longitudinal displacement of said jaws.

7. The assembly of claim 6 wherein said jaws and said yoke portion are formed as a unitary member.

8. The assembly of claim 7 wherein said unitary member comprises a generally U-shaped plastics component.

9. The assembly of claim 6 including a resiliently compressible buffer member accommodated within said mouth in position to confront and be compressed by the striker element as it is moved to its inward position within said mouth.

10. The assembly of claim 9 wherein said buffer member is accommodated between said jaws adjacent said yoke.

11. The assembly of claim 4 wherein said jaws have laterally outer wedge-shaped faces that converge longitudinally inwardly of said mouth, said body having complemental opposing wedge-shaped faces converging longitudinally inwardly and co-acting with said faces of said jaws to effect said lateral inward displacement of said jaws upon said longitudinal inward displacement of said jaws.

12. A latch assembly for operative mounting on one of two relatively movable components of a vehicle for releasable engagement with a striker element mounted on the other of the two components to secure the components in a closed condition, said assembly comprising a latch body having a mouth for receiving the striker element; a releasable catch mechanism operative to retain the striker element at an inward closed position within said mouth; and a pair of jaws spaced on laterally opposite sides of said mouth, at least one of said jaws being longitudinally displaceable relative to said body between longitudinally inward and outward positions within said mouth and being resiliently urged toward said outward position to enable the striker element to enter between said jaws and carry said at least one jaw inward with the striker element, said at least one jaw and said body having co-acting wedging surfaces acting to urge said at least one jaw laterally toward the other jaw upon said inward longitudinal displacement to provide lateral gripping engagement with the striker element.

13. The assembly of claim 12 wherein both of said jaws are longitudinally and laterally displaceable, are resiliently urged to said outward position, and are carried inward by the striker element, each of said jaws having wedging surfaces that co-act with wedging surfaces of said body upon said inward displacement of said jaws to provide said gripping engagement with the striker element and to urge the striker element toward a laterally centered position within said mouth.

14. The assembly of claim 13 wherein said jaws are linked by a yoke inward of said mouth, said yoke being operative to interact with the striker element to effect said longitudinally inward displacement of said jaws.

15. The assembly of claim 14 wherein said jaws and said yoke are formed as a unitary component.

16. The assembly of claim 15 wherein said unitary component is generally U-shaped and formed of plastics material.

17. The assembly of claim 14 including a resilient buffer accommodated within said mouth in position to confront and be compressed by the striker element when in its closed position.

18. The assembly of claim 17 wherein said buffer comprises a body of elastomeric material.

19. The assembly of claim 18 wherein said buffer is accommodated between said jaws adjacent said yoke in position to be compressed between said yoke and the striker element.

20. The assembly of claim 14 wherein said wedging surfaces of said jaws have laterally outward wedge-shaped faces converging longitudinally inwardly of said mouth and said wedging surfaces of said latch body include complementary wedge shaped faces co-acting with said faces of said jaws to effect said laterally inward displacement of said jaws.

21. A latch assembly comprising:

a latch body having an elongate longitudinally extending mouth open at one end to receive a striker element therein;

a catch mechanism mounted on said latch body in position to confront and releasably retain the striker element at an inward closed position within said mouth;

and a generally U-shaped displaceable member carried on said body including a pair of jaw portions arranged on laterally opposite sides of said mouth to accommodate the striker element therebetween and an integral yoke portion joining said jaw portions inward of said mouth, said member being slideable longitudinally inwardly of said mouth and said jaws and said body having co-acting wedge-shaped surfaces operative to urge said jaws laterally inwardly in response to said longitudinal inward sliding of said member.

* * * * *